United States Patent [19]

Kindlmann et al.

[11] Patent Number: 4,462,457

[45] **Date of Patent: * Jul. 31, 1984**

[54] TRANSFORMER-DRIVEN SHIELD FOR ELECTROMAGNETIC CASTING

[75] Inventors: Peter J. Kindlmann, Northford; John C. Yarwood, Madison; Gary L. Ungarean, Woodbridge; Derek E. Tyler, Cheshire, all of Conn.

[73] Assignee: Olin Corporation, New Haven, Conn.

[ * ] Notice: The portion of the term of this patent subsequent to Aug. 25, 1998 has been disclaimed.

[21] Appl. No.: 421,653

[22] Filed: Sep. 22, 1982

Related U.S. Application Data

[60] Continuation of Ser. No. 231,209, Feb. 4, 1981, abandoned, which is a division of Ser. No. 111,485, Jan. 14, 1980, Pat. No. 4,285,387.

[51] Int. Cl.[3] ..... B22D 27/02

[52] U.S. Cl. ..... 164/503

[58] Field of Search ..... 164/466, 467, 498, 503, 164/507, 513, 493, 471, 147.1, 148.1, 502; 219/10.75, 10.79

[56] References Cited

U.S. PATENT DOCUMENTS

| | | | |
|---|---|---|---|
| 1,607,264 | 11/1926 | Ledwinka et al. | 219/10.79 X |
| 2,383,992 | 9/1945 | Sherman | 219/10.79 X |
| 2,408,229 | 9/1946 | Roberds | 219/10.79 |
| 2,456,091 | 12/1948 | Stevens et al. | 219/10.79 |
| 2,478,640 | 8/1949 | Roberds | 219/10.79 X |
| 3,431,382 | 3/1969 | Esche et al. | 219/10.75 X |
| 3,467,166 | 9/1969 | Getselev et al. . | |
| 3,605,865 | 9/1971 | Getselev . | |
| 3,646,988 | 3/1972 | Getselev . | |
| 3,649,804 | 3/1972 | Kasper | 219/10.79 X |
| 3,702,155 | 11/1972 | Getselev . | |
| 3,735,799 | 5/1973 | Karlson . | |
| 3,741,280 | 6/1973 | Kozheurov et al. . | |
| 3,773,101 | 11/1973 | Getselev . | |
| 3,985,179 | 10/1976 | Goodrich et al. . | |
| 4,004,631 | 1/1977 | Goodrich et al. . | |
| 4,135,568 | 1/1979 | Brooks . | |

FOREIGN PATENT DOCUMENTS

| | | | |
|---|---|---|---|
| 707071 | 4/1954 | United Kingdom | 219/10.79 |

*Primary Examiner*—Kuang Y. Lin

*Attorney, Agent, or Firm*—Howard M. Cohn; Barry L. Kelmachter; Paul Weinstein

[57] ABSTRACT

An electromagnetic casting process and apparatus utilizing an active transformer-driven copper shield. The shield is actively driven with a voltage out of phase with the voltage in the containment inductor with the result that a bucking current is produced in the shield which is out of phase with the current induced in the shield by the inductor. An active transformer-driven duplex variable impedance shield is also disclosed.

8 Claims, 6 Drawing Figures

TRANSFORMER-DRIVEN SHIELD FOR ELECTROMAGNETIC CASTING

BACKGROUND OF THE INVENTION

This application is a continuation of U.S. application Ser. No. 231,209, filed Feb. 4, 1981, now abandoned by Peter J. Kindlmann et al. for TRANSFORMER-DRIVEN SHIELD FOR ELECTROMAGNETIC CASTING, which in turn is a division of U.S. application Ser. No. 111,485, filed Jan. 14, 1980, by Peter J. Kindlmann et al. for TRANSFORMER-DRIVEN SHIELD FOR ELECTROMAGNETIC CASTING, now U.S. Pat. No. 4,285,387.

The present invention relates to an improved process and apparatus for casting metals and alloys, particularly copper and copper alloys, utilizing an active transformer-driven shield. Electromagnetic casting of metals and alloys has been known and used for many years.

PRIOR ART STATEMENT

Known electromagnetic casting apparatus comprises a three part mold consisting of a water cooled inductor, a non-magnetic screen, and a manifold for applying cooling water to a forming ingot. Such an apparatus is exemplified in U.S. Pat. No. 3,467,166 to Getselev et al. Containment of the molten metal is achieved without direct contact between the molten metal and any component of the mold. Solidification of the molten metal is achieved by direct application of water from the cooling manifold to the ingot shell.

The prior art in electromagnetic containment and casting of molten metal generally discloses the use of an alternating magnetic field of an inductor to provide a means of inducing electromagnetic pressure within the primary casting area for containing molten metal. The electromagnetic pressure effected in the prior art is controlled to counterbalance the variable metallostatic pressure through the use of non-magnetic shields or screens, such as those exemplified by U.S. Pat. Nos. 3,646,988, 3,773,101, 3,605,865, 3,985,179, 3,467,166, 3,741,280, 4,004,631, 3,702,155, and 3,735,799. These shields act to attenuate the magnetic field generated by the primary inductor in such a way as to maintain vertical or near vertical side walls in the liquid, especially in the vicinity of the solid-liquid interface. These shields are normally positioned above the liquid-solid interface and at least partially between the inductor and the molten metal. Currents are induced within the shield to an extent which depends on the shield's electrical impedance. The shield itself can be considered as a counter inductor.

The aforenoted prior art discloses various arrangements between the inductor and the shield to effect the required shape control and permit control of ingot solidification in this process. For example, it is known to design the shield to have increasing thickness in a vertical, upwards direction so as to shield more effectively at a greater height above the liquid-solid interface. In addition, it is known to move the shield in a vertical plane, thus providing a variable inductance and permitting fine control of ingot shape, particularly adjacent to the molten metal meniscus (see U.S. Pat. No. 3,605,865).

One drawback of the shield shape control of U.S. Pat. No. 3,605,865 is that movement of the shield during casting has a detrimental effect on ingot solidification, particularly when the shield is used to deflect the water cooling stream onto the solidifying ingot surface, since movement of the shield results in movement of the coolant impact location and a corresponding movement of the liquid-solid interface.

Another type of shield is depicted in U.S. Pat. No. 4,135,568 which shows a shield for use in electromagnetic casting comprised of segmental strips arranged to form a tubular-shaped segmented shield structure.

With respect to materials of construction for screens, U.S. Pat. No. 3,605,865 teaches that materials of construction are frequency dependent. Copper or aluminum is disclosed as usuable at frequencies of 50 to 500 Hz and non-magnetic steels at frequencies from 1000 to 2500 Hz. The use of high resistivity non-magnetic stainless steels as passive screens at frequencies above 1 KHz, although desirable from a screening viewpoint, is however undesirable in terms of energy efficiency. p One approach to utilizing materials of low resistivity at higher frequencies is disclosed in copending U.S. Pat. No. 4,265,294 entitled "Duplex Impedance Shield For Shape Control in Electromagnetic Casting", which discloses the use of a duplex or variable duplex impedance shield that because of its duplex structure enables use of low resistivity materials such as aluminum and copper in shield structures used at frequencies in the medium range of 1 to 10 KHz.

As discussed in U.S. Pat. No. 4,265,294, current frequencies typically used in electromagnetic casting range from 1 to 10 KHz. Shields utilized in electromagnetic casting must be semipermeable in nature by virtue of their resistivity and thickness in order to provide attenuation rather than elimination of the magnetic field. Consequently, stainless steel or a material of similar resistivity is typically used in the art. This material provides the required semi-permeable property when utilized in reasonable engineering dimension, for example in the order of 5 mm thick. In effect such shields are constructed of material of one penetration depth or less at the frequency of interest.

At medium frequencies, 1 to 10 KHz, a copper shield of only 0.5 to 2 mm thickness would be thin and flimsy and quite unreasonable in an engineering (strength) sense. Stainless steel at 4 to 13 mm thickness over this frequency range is a much more practical material. On the other hand, at frequencies lower than 500 Hz, it becomes more practical to use copper in the 3 to 9 mm thickness range. Stainless steel would be of less value here since it is so transparent with $\delta$ in the 20 to 60 mm range.

In utilizing a secondary section or loop as disclosed in U.S. Pat. No. 4,265,294, the inductance of the shield is artifically increased permitting use of a copper or aluminum shield in the medium frequency range of 1 to 10 KHz typically used in electromagnetic casting. Increased inductance in the shield lowers the induced current in the shield (shielding current) making it semipermeable. Because the shield is now thicker (typically 3–10 mm),it is possible to utilize copper or aluminum without incurring severe engineering limitations. Prior to the present invention, and in the absence of a secondary loop, use of copper or aluminum thick enough to be of sufficient strength would provide too high a shielding current thereby totally shielding the molten metal head from the inductor.

Use of low resistivity material such as copper as a shield material is highly desired since the resistivity of copper is considerably less than the resistivity of stainless steel for example, and thus the resistance of the shield is less. Lowering of shield resistance reduces the power loss of the system, i.e. real power dissipation would be lessened.

All of the aforementioned prior art screens are passive, are limited as to overall versatility and adjustability, and operate at lower electrical efficiency than desired.

The present invention overcomes the deficiencies described above and provides a highly desirable mean for utilizing low resistivity screens in the 1-10 KHz range to provide ingot shape control in electromagnetic casting of metals and alloys, and in addition provides a versatile, easily adjustable screen, which operates with higher electrical efficiency than passive screens of the prior art.

All U.S. patents and applications described herein are intended to be incorporated by reference.

SUMMARY OF THE INVENTION

This invention relates to utilization of an active transformer-driven shield for shape control in electromagnetic casting of metals and alloys. In the preferred form, current drive through the shield is established by connection to a transformer so that the applied voltage to the shield is 180° out of phase with that in the containment inductor. This provision of an actively-driven shield enables it to be constructed out of more desirable materials, e.g. copper and aluminum, while simultaneously providing a more versatile, easily adjustable shield which operates with higher electrical efficiency than passive shields of the prior art.

In accordance with another aspect of the present invention, finer tuning of an active transformer-driven shield is provided by connection of a duplex variable impedance shield to the transformer and/or connection of a capacitor in series with the transformer primary.

Accordingly, it is an object of this invention to provide an improved process and apparatus for electromagnetically casting metals and alloys.

It is another object of this invention to provide an improved shield for attenuating the magnetic field generated by the inductor in an electromagnetic casting apparatus and process.

These and other objects will become more apparent from the following description and drawings.

DETAILED DESCRIPTION OF THE PREFERRED EMBODIMENTS

Figure 1:
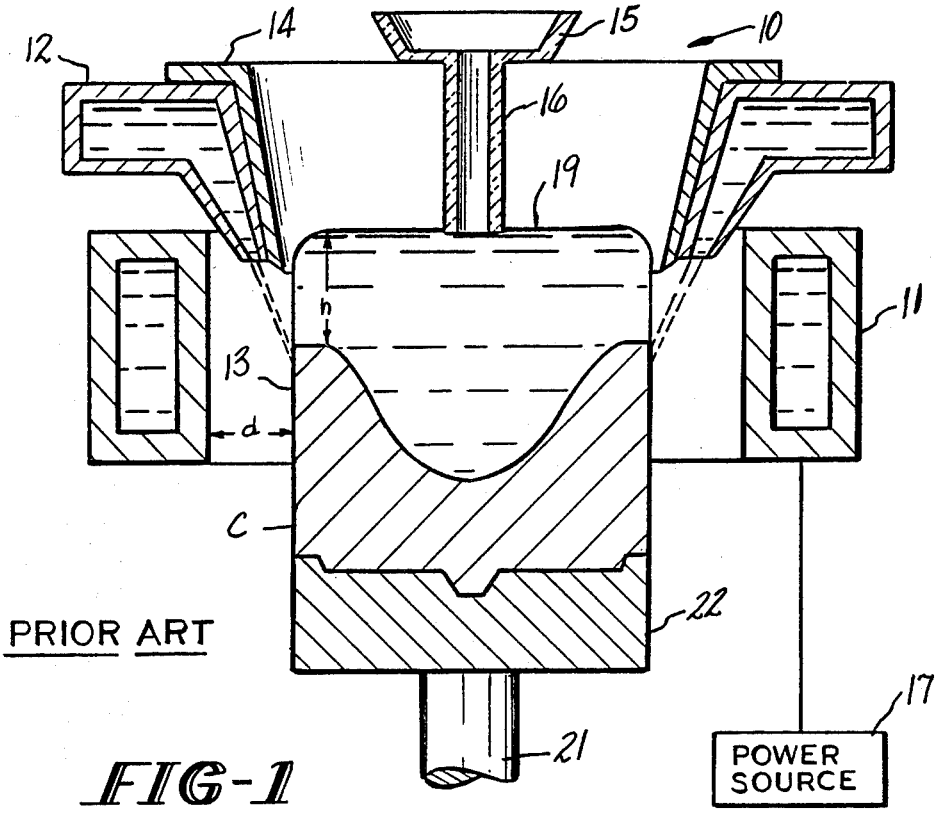
FIG. 1 is a schematic representation of a prior art electromagnetic casting apparatus.

Referring now to FIG. 1, there is shown therein a prior art electromagnetic casting apparatus. The electromagnetic casting mold 10 is comprised of an inductor 11 which is water cooled; a cooling manifold 12 for applying cooling water to the peripheral surface 13 of the metal being cast C; and a non-magnetic shield 14. Molten metal is continuously introduced into the mold 10 during a casting run using a trough 15 and a downspout 16 and conventional molten metal head control. The inductor 11 is excited by an alternating current from a power source 17.

The alternating current in the inductor 11 produces a magnetic field which interacts with the molten metal head 19 to produce eddy currents therein. These eddy currents in turn interact with the magnetic field and produce forces which apply a magnetic pressure to the molten metal head 19 to contain it so that it solidifies in a desired ingot cross section.

An air gap d exists during casting between the molten metal head 19 and the inductor 11. The molten metal head 19 is formed or molded into the same general shape as the inductor 11 thereby providing the desired ingot cross section. The inductor may have any desired shape including circular or rectangular as required to obtain the desired ingot C cross section.

The purpose of the non-magnetic shield 14 is to fine tune and balance the magnetic pressure with the hydrostatic pressure of the molten metal head 19. The non-magnetic shield 14 may comprise a separate element as shown or may, if desired, be incorporated as a unitary part of the manifold for applying the coolant. As described in the prior art, non-magnetic shields are normally of fixed geometry and are positioned above the liquid-solid interface between the primary inductor and the molten metal and act to attenuate the magnetic field generated by the primary inductor. Currents are induced within the shield to an extent which depends on the shield's electrical impedance and coupling to inductor 11. Such currents shield and attenuate the field at the molten metal surface. The impedance of the shield reflects both its inductance and resistance. The inductance depends on the air gaps between inductor and shield, and the shield and ingot; resistance depends on the geometry and resistivity of the shield.

Initially, a conventional ram 21 and bottom block 22 is held in the magnetic containment zone of the mold 10 to allow the molten metal to be poured into the mold at the start of the casting run. The ram 21 and bottom block 22 are then uniformly withdrawn at a desired casting rate.

Solidification of the molten metal which is magnetically contained in the mold 10 is achieved by direct application of water from the cooling manifold 12 to the ingot surface 13. In the prior art embodiment shown in FIG. 1, the water is applied to the ingot surface 13 within the confines of the inductor 11. The water normally may be applied to the ingot surface 13 above within or below the inductor 11 as desired.

The present invention is concerned with the provision of an actively-driven shield in an electromagnetic casting apparatus for use at typical electromagnetic casting frequencies which will attenuate the magnetic field generated by the primary inductor in the manner described hereinabove while simultaneously providing a more versatile, easily adjustable shield which operates with higher electrical efficiency than passive screens of the prior art, and which permits the use of desirable low resistivity shield materials, e.g. copper, aluminum, and alloys thereof.

Figure 2:
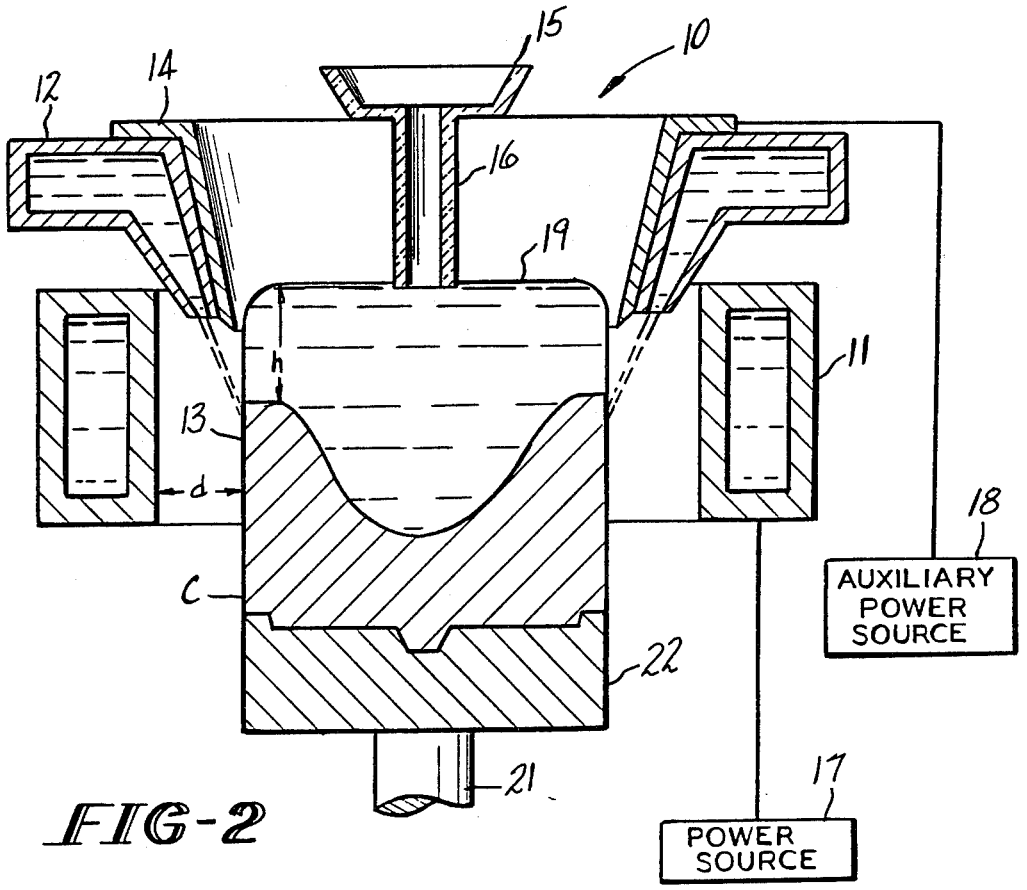
FIG. 2 is a schematic representation of an electromagnetic casting apparatus in accordance with the present invention, showing an auxiliary power source attached to the shield.

FIG. 2 shows a schematic representation of an electromagnetic casting apparatus in accordance with this invention showing an auxiliary power source 18 which is utilized to drive shield 14'. Shield 14' can be externally or internally cooled in a known manner. In the embodiment of FIG. 2, shield 14' is shown immediately adjacent manifold 12. Inasmuch as shield 14' carries current, if manifold 12 is constructed of a conductive material, shield 14' should be insulated therefrom. If manifold 12 is constructed of a nonconductive material, such insulating is unnecessary. Like numerals in the various drawing figures denote like parts.

Figure 3:
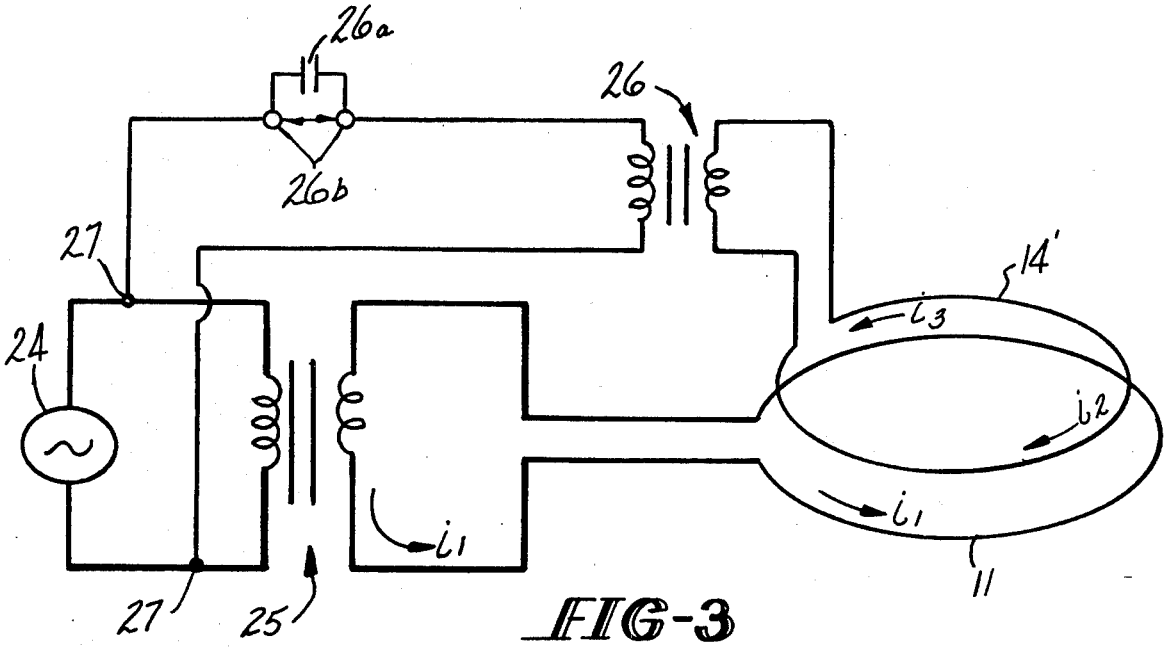
FIG. 3 is an electrical schematic of an electromagnetic casting system in accordance with the present invention.

A fuller understanding of the present invention can be had by reference to FIG. 3, wherein an electrical schematic circuit of a preferred embodiment of the electromagnetic casting apparatus in accordance with the present invention can be found. Referring to FIG. 3, generator 24 provides an electrical potential across the primary of main step down transformer 25 whereby the necessary current $i_1$ at a desired frequency and voltage is supplied to the inductor 11. In accordance with the present invention, shield 14' is driven from the secondary of auxiliary step down transformer 26, the primary of which is connected across the primary of, if more convenient, the secondary (not shown) of main transformer 25. A current drive through the shield, $i_3$, is thus established so that the applied voltage is substantially 180° out of phase with that in the containment inductor 11. This is accomplished by establishing the polarity of connections 27 in such a way as to develop the desired phase shift, reversing the polarity if necessary. This arrangement produces a current $i_3$ in a shield 14' which is substantially 180° out of phase with the current $i_2$ induced in the shield by the inductor 11. The "net current" in the shield then becomes the vector sum of the "driven current" $i_3$ and the "induced current" $i_2$, which given the phase relationship, is less than the induced current in a passive shield of the same shape and location. A tuning capacitor **26*a* can be substituted for the direct connection across terminals 26*b***. Use of such a tuning capacitor permits manipulation of the "driven current" phase. This adds further flexibility to the control over the magnitude of the shield "net current".

As discussed hereinabove, a copper, aluminum, or other low resistivity material shield of the same shape and location as a stainless steel shield would reduce magnetic pressure at the liquid metal meniscus too much by attenuating too much or all of the magnetic field. However, in accordance with the instant invention utilization of a low resistivity shield of the same geometry and location is rendered possible by the fact that the excess current is "bucked" by means of the "driven current" that is substantially 180° out of phase with it.

It is contemplated in accordance with the present invention to utilize a separate power source or auxiliary power source in place of the auxiliary transformer 26. Synchronization of the inductor power source and the auxiliary shield power source would, of course, be necessary, and such a synchronization would be difficult. Use of auxiliary transformer 26 is preferred in that by driving the auxiliary transformer 26 from the primary of main transformer 25 the system is synchronized. The phase shift is indicated as being substantially 180° hereinabove. An ideal phase shift of 180° is not readily attainable inasmuch as there is some minor phase shift through the auxiliary transformer 26 as a result of winding self-inductance effects. Moreover, the phase of the induced shield current is affected by the combined positive losses in inductor 11, ingot surface 13 and shield 14 itself. For purposes of this invention, however, a phase shift of substantially or approximately 180° is sufficient.

Adjustment of the active shield system of the instant invention is accomplished primarily by utilizing the proper turns ratio in the auxiliary transformer, and possibly a suitable capacitor **26*a***, so that the magnitude of $i_3$, and thus the net shield current, is equal to what is desired for the particular metal or alloy and electromagnetic casting system geometry which is being used. Such determinations can, of course, be made empirically by utilizing models of the electromagnetic casting system and/or by experimentation with the system itself.

Figure 4:
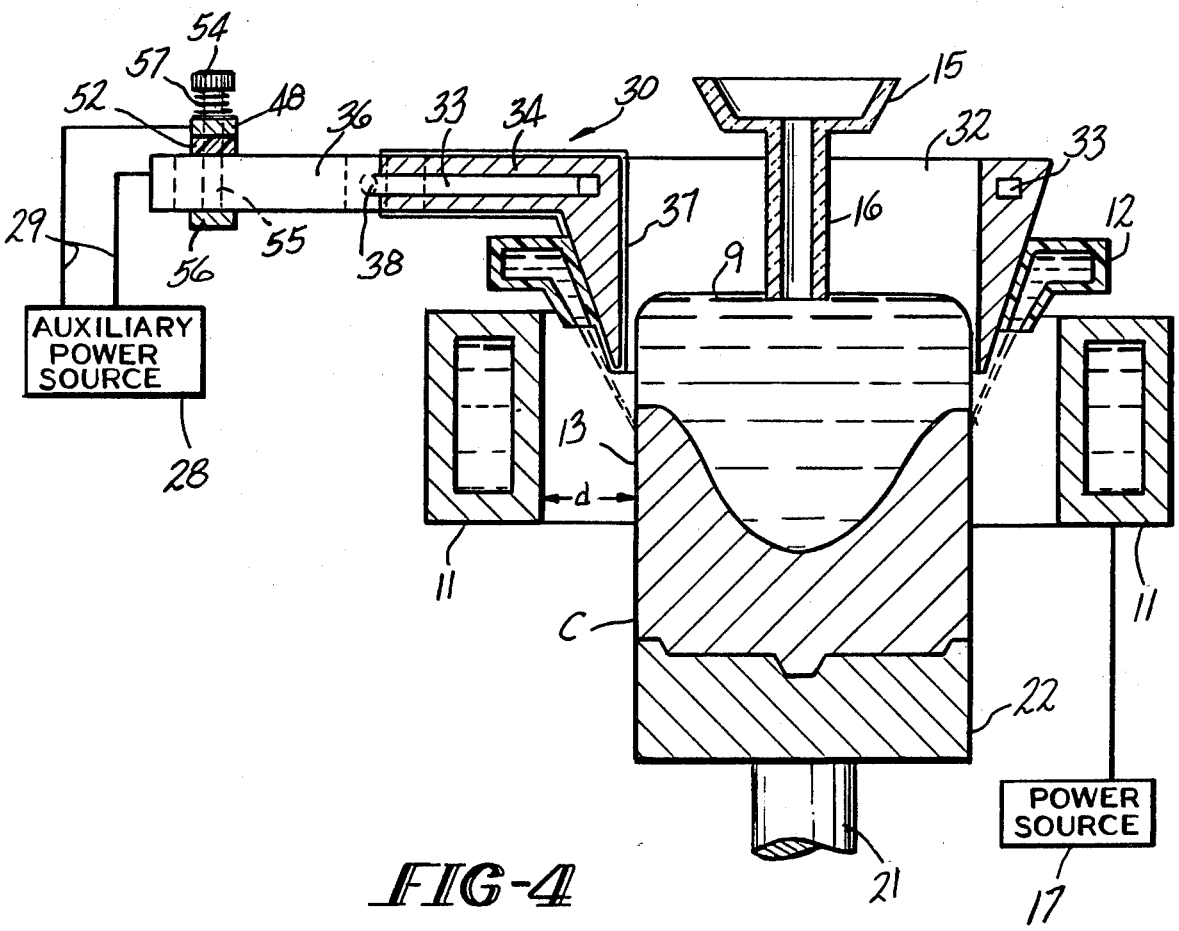
FIG. 4 is a schematic representation of another embodiment of an electromagnetic casting apparatus in accordance with the present invention, showing an auxiliary power source attached to a duplex variable impedance shield.
Figure 6:
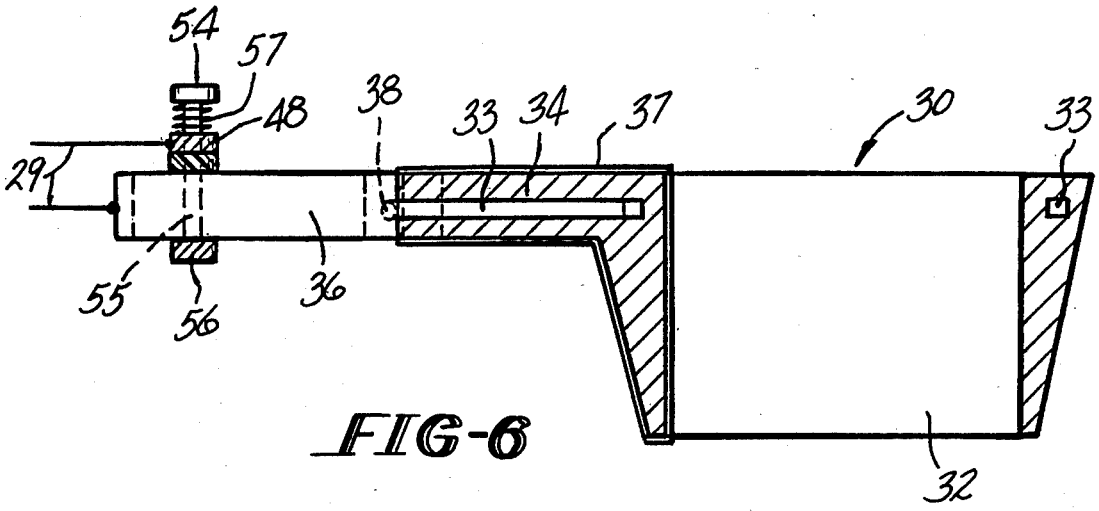
FIG. 6 is a cross section taken along the line 6—6 of FIG. 5 of the active duplex variable impedance shield in FIG. 5.
Figure 5:
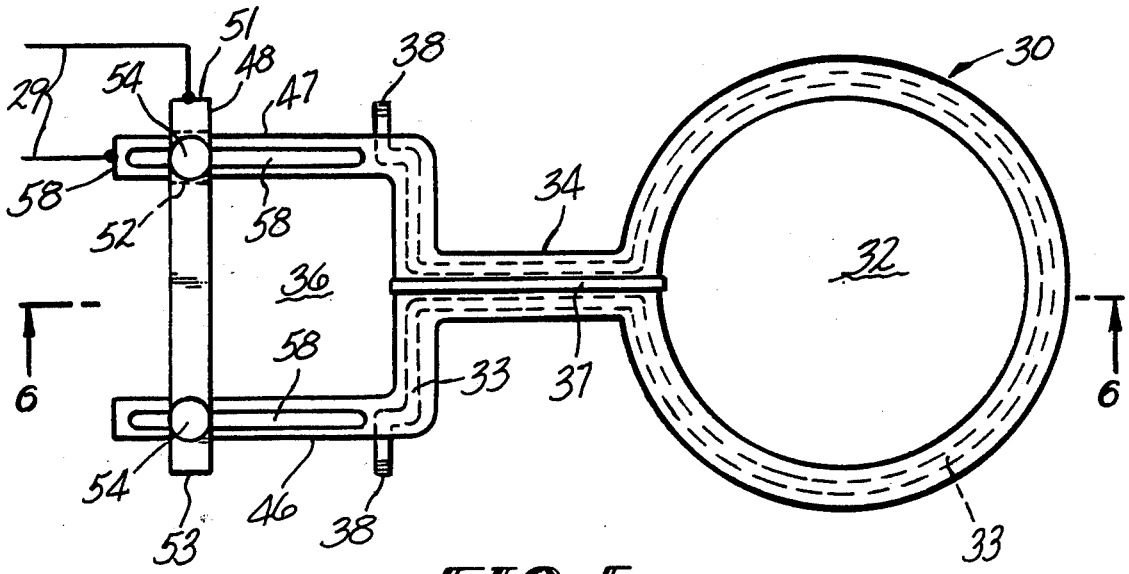
FIG. 5 is a top view of the active duplex variable impedance shield depicted in FIG. 4, showing the leads of an auxiliary power source attached thereto.

Tuning of the electromagnetic casting system of the present invention via selection of appropriate transformer turn ratio and series capacitor **26*a* can be enhanced in accordance with yet another embodiment of the present invention as depicted in FIGS. 4, 5, and 6. Transformers are typically multiple tap, that is they can be adjusted in incremental units but not continuously, e.g. 5:1, 6:1, etc. Actively driving a variable duplex impedance shield, such as those disclosed in the aforementioned prior U.S. Pat. No. 4,265,294, enables tuning of the electromagnetic casting system of the present invention between the unit steps of the auxiliary transformer 26 and provides an additional control over phase shift of the out of phase bucking current $i_3$. Depending on the particular duplex variable impedance shield selected, either more tuning steps can be added between the transformer steps, or the system can be rendered continuously tunable. Altering of transformer 26** taps primarily affects bucking current amplitude, while varying the impedance of the shield enables adjustment of the phase shift by introducing more or less reactance.

FIGS. 4 through 6 show an auxiliary power source 28 with leads 29 attached to sliding bar duplex variable impedance shield 30.

Duplex impedance shield 30 is comprised of a primary loop 32 which is located adjacent to and in surrounding relation to molten metal head 19 and inside inductor 11, and a secondary loop 36 located remote from the casting station area. Shield primary and secondary loops 32 and 36 are interconnected by a transition section 34. Transition section 34 is provided with insulation 37 to prevent shorting out of the overall loop of shield 30. Insulation 37 might typically be constructed of a thermosetting high temperature plastic such as fiberglass reinforced phenolic or fiberglass reinforced silicone.

Shield 30 may be externally cooled but is preferably provided with hose nipples 38 for supplying a cooling liquid such as water to internal passages 33 within shield 30.

In shielding, shield 30 acts as an electrical element into which current is induced. The magnitude of this induced current depends on the electrical impedance (Z) of the shield circuit. Typically, the impedance of the shield circuit 30 is made up of inductance (L) and resistance (R), with inductance (L) being the greater contributor. By placing the secondary loop 36 on the shield, the shield 30 behaves as if a larger air gap exists between forming molten metal head 19 and shield 30. This has the effect of automatically increasing both the resistance (R) and the inductance (L) of the shield 30. It is generally preferred to provide a predominantly inductive or reactive secondary shield loop since less power is consumed by increasing the inductance (L) than by increasing the resistance to accomplish an equivalent increase of shield impedance. Indeed, the reactive nature of the above shield circuit provides more leverage or control of impedance by manipulating the inductance (L) rather than the resistance (R).

The impedance of the shield circuit 30 can be varied by virtue of an adjustable shunt across the secondary loop which can be manipulated to vary the extent of the air gap enclosed by the shield, and hence its inductance.

Referring to FIGS. 4, 5, and 6, a secondary loop 36 comprises two legs 46, 47 and shunt bar 48 is spanning engagement therewith. Shunt bar 48 is maintained in firm engagement with legs 46, 47 by control knobs 54 which are attached to through-pins 55. Good electrical contact is maintained between end 53 of shunt bar 48 and leg 46 as a result of the pressure exerted by spring 57 against knobs 54 under surface and the top surface of shunt bar 48. Firm engagement of the other end 51 of shunt bar 48 is maintained by a second spring 57 in like manner. Retainers 56 of through-pins 55 prevent accidental removal of shunt bar 48 along legs 46, 47 by sliding of through-pins 55 along slots 58. In this manner, the impedance of the shield 30 can be controlled, and by introducing more or less reactance adjustment of the phase shift in the actively-driven shield can be obtained.

End 51 of shunt bar 48 is prevented from making electrical contact with leg 47 via interposition of the insulating element 52 between the leg 47 and the end 51 of shunt bar 48. Through-pin 55 at end 51 may be provided with an insulator sleeve (not shown) to prevent electrical contact between end 51 and leg 47. Through-pin 55 at end 51 and retainer 56 could alternatively be constructed of a non-conducting material, such as for example plastic. Thus, by connecting one of the leads 29 from auxiliary power source 28 to the end 51 of shunt bar 48 and the other lead to the end 58 of leg 47 a loop for flow of bucking current $i_3$ is established. Ready continuous adjustment of the actively-driven shield 30 can now be accomplished by adjustment of the auxiliary power source 28 and/or by sliding of the shunt bar 48 along legs 46, 47 of shield 30.

It is preferred to cool the shield 30 in operation because as the temperature of the shield rises the effect is to raise the resistance and thereby the impedance of the shield. Cooling could be carried out by passing a cooling fluid such as for example water through passages 33 provided in the shield, by spraying the shield with such a cooling fluid, or by placing the secondary loop 36 of the shield in a non-conducting bath of for example oil.

It should be understood that the active shield teachings of the present invention are adaptable to shields of whatever geometry and design that might be contemplated under other considerations, by simply opening the shield enough to attach auxiliary power source leads and establish a bucking current loop. Insertion of an insulating material in the opening would be optional and would depend on considerations such as shorting, potential, rigidity, provision of coolant passages, etc.

It is apparent that there has been provided with this invention a novel electromagnetic casting process and apparatus utilizing a transformer-driven shield which fully satisfy the objects, means, and advantages set forth herein before. While the invention has been described in combination with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

What is claimed is:

1. An apparatus for shape control in electromagnetic casting of molten materials, comprising:

means for providing a magnetic field;

an active non-magnetic shield comprising a primary loop magnetic field shielding means for attenuating said magnetic field by intercepting a portion of said magnetic field so that a current is induced in said shielding means; and means for delivering a bucking current to said primary loop shielding means, said bucking current being selected such that it is out of phase with said current induced in said shielding means by said magnetic field whereby in operation the resulting net current in said shielding means is less than the induced curent.

2. An active non-magnetic shield as in claim 1 further including means for adjusting the phase of said bucking current.

3. An active non-magnetic shield as in claim 2 wherein said adjusting means comprises a capacitor connected in series with said primary shielding means.

4. An active non-magnetic shield as in claim 3 wherein said means for delivering a bucking current comprises a transformer, the secondary of which is connected to said primary loop shielding means.

5. An active non-magnetic shield as in claim 4 constructed of a material selected from the group comprising copper, aluminum, and alloys thereof.

6. An active non-magnetic shield as in claim 4 further including means for varying the overall impedance of said shielding means.

7. An active non-magnetic shield as in claim 6 further including a secondary loop attached to said primary loop shielding means to also carry said bucking current.

8. An active non-magnetic shield as in claim 7 wherein said secondary loop includes two legs and a movable shunt means in bridging engagement therewith adapted for movement along said legs, whereby the impedance of said secondary loop and, therefore, the overall impedance of said shielding means can be varied.

* * * * *